US007065904B2

(12) United States Patent
Lee et al.

(10) Patent No.: US 7,065,904 B2
(45) Date of Patent: Jun. 27, 2006

(54) LAUNDRY DRYER

(75) Inventors: Soon Jo Lee, Changwon-si (KR); Hwan Joo Myung, Suwon-si (KR); Young Jin Doh, Busan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/006,694

(22) Filed: Dec. 8, 2004

(65) Prior Publication Data

US 2005/0120585 A1 Jun. 9, 2005

(30) Foreign Application Priority Data

Dec. 9, 2003 (KR) ..... 10-2003-0088856
Dec. 11, 2003 (KR) ..... 10-2003-0089999
Dec. 12, 2003 (KR) ..... 10-2003-0090517

(51) Int. Cl.
*F26B 11/02* (2006.01)

(52) U.S. Cl. ..... 34/601; 8/159

(58) Field of Classification Search ..... 34/596, 34/602, 603, 601; 8/159
See application file for complete search history.

(56) References Cited

U.S. PATENT DOCUMENTS 2,454,392 A * 11/1948 Jorgenson ..... 34/599
3,277,584 A * 10/1966 Krolzick ..... 34/601
5,062,219 A * 11/1991 Harris et al. ..... 34/606
5,901,465 A * 5/1999 Boussetta et al. ..... 34/602
6,698,107 B1 3/2004 Song et al.

* cited by examiner

*Primary Examiner*—S. Gravini

(57) ABSTRACT

A laundry dryer includes a dry drum in which laundry is loaded, a noise reduction member mounted on an outer circumference of the dry drum to absorb vibration/noise, a lift attached on an inner circumference of the dry drum to lift the laundry, a coupling member coupling the noise reduction member and/or the lift to the dry drum, and a belt disposed around the dry drum.

27 Claims, 18 Drawing Sheets

LAUNDRY DRYER

BACKGROUND OF THE INVENTION

1. Field of the Invention

The present invention relates to a laundry dryer, and more particularly, to a laundry dryer having a device that can reduces vibration and noise, which are generated by laundry rotating in a dry drum, as well as vibration and noise, which are generated by interferences between a rotational belt disposed on an outer circumference of the dry drum and a head portion of a coupling member inserted in the dry drum.

2. Description of the Related Art

Generally, a drum-type laundry dryer is designed to perform the drying operation while rotating laundry loaded in a dry drum. The laundry rotates and drops by the rotation of the laundry drum. High-temperature dry air introduced into the dry drum is mixed with the laundry to vaporize the moisture soaked in the laundry. The laundry dryer may be classified into a condenser-type dryer and an exhaust-type dryer. The former is designed such that the air in the dry drum is directed to a condenser and a heater and is then returned to the dry drum. That is, the air circulates in the dryer without being exhausted out of the dryer. The latter is designed such that the air in the dry drum is directed to the condenser so that the moisture contained in the air can be eliminated and is then exhausted out of the dryer.

Describing in more detail, in the condenser-type dryer, the air circulating in the dryer absorbs the moisture from the laundry loaded in the drum and passes through the condenser to be lowered in its temperature by a heat-exchange. As the temperature of the air is lowered, the moisture contained in the air is condensed. The condensed water is pumped out by an condensing pump and is then exhausted to an exterior side.

In the exhaust-type dryer, high-temperature high-moisture air absorbing moisture from the laundry in the drum is exhausted out of the dryer via a lint filter.

In both the exhaust-type and condenser type dryers, as the laundry lifts and drops by the rotation of the drum, heat-exchange is briskly incurred.

The structure of the convention drum and dryer operation is disclosed in U.S. Pat. No. 6,698,107 assigned to an applicant of this application.

However, in the prior laundry dryer, noise is incurred as hard objects such as zippers and buttons that are attached on the laundry and coins in pockets collide with an inner wall of the drum in the course of the drum and the laundry rotate. Furthermore, the drum functions as a resonance drum, the incurred noise may be boosted.

To solve this problem, the drum is designed to be thick. In this case, since the weight of the drum is increased, making it difficult to perform the assembling process. Furthermore, the thick drum causes the manufacturing costs to be increased.

Meanwhile, a belt is mounted on an outer circumference of the dry drum to rotate the dry drum. The belt is connected to a motor shaft of a driving motor. A lift for lifting the laundry is mounted in the dry drum. That is, the lift is fixed on an inner circumference of the dry drum by a coupling member penetrating the dry drum from an outer side. In this case, the belt interferes with a head portion of the coupling member extending from the outer circumference of the dry drum, as a result of which the belt may be damaged. Sometimes, the belt may be broken, thereby stopping the rotation of the dry drum and allowing only the motor to rotate. As a result, power consumption and maintenance costs are increased.

In addition, the interference between the belt and the head portion of the coupling member may cause the additional noise.

SUMMARY OF THE INVENTION

Accordingly, the present invention is directed to a laundry dryer that substantially obviates one or more problems due to limitations and disadvantages of the related art.

An object of the present invention is to provide a laundry dryer having a structure that can prevent vibration and noise from being incurred in the drum.

Another object of the present invention is to provide a laundry dryer having a structure that can prevent the belt disposed on an outer circumference of a dry drum from interfering with a head portion of a coupling member.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a laundry dryer comprising: a dry drum in which laundry is loaded; at least one noise reduction member mounted on an outer circumference of the dry drum to absorb vibration/noise; a lift attached on an inner circumference of the dry drum to lift the laundry; a coupling member coupling the noise reduction member and/or the lift to the dry drum; and a belt disposed around the dry drum.

In another aspect of the present invention, there is provided a laundry dryer comprising: a dry drum; a lift attached on an inner circumference of the dry drum to move the laundry; a strip-shaped noise reduction member disposed around an outer circumference of the dry drum to absorb vibration, the noise reduction member being provided at an end with a coupling end; and a coupling member for coupling the noise reduction member to the outer circumference of the dry drum.

In still another aspect of the present invention, there is provided a laundry dryer comprising: a dry drum in which laundry is loaded; a lift mounted in an inner circumference of the drum in a direction of an axis, the lift being provided with a coupling guide projection; and a noise reduction member mounted on an outer circumference of the dry drum, the noise reduction member being at an end with at least one coupling hole in which a coupling member is inserted.

According to the present invention, the vibration and noise generated in the drum can be remarkably reduced.

In addition, as the interference between the belt and the head portion of the coupling member can be prevented, the noise can be further reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
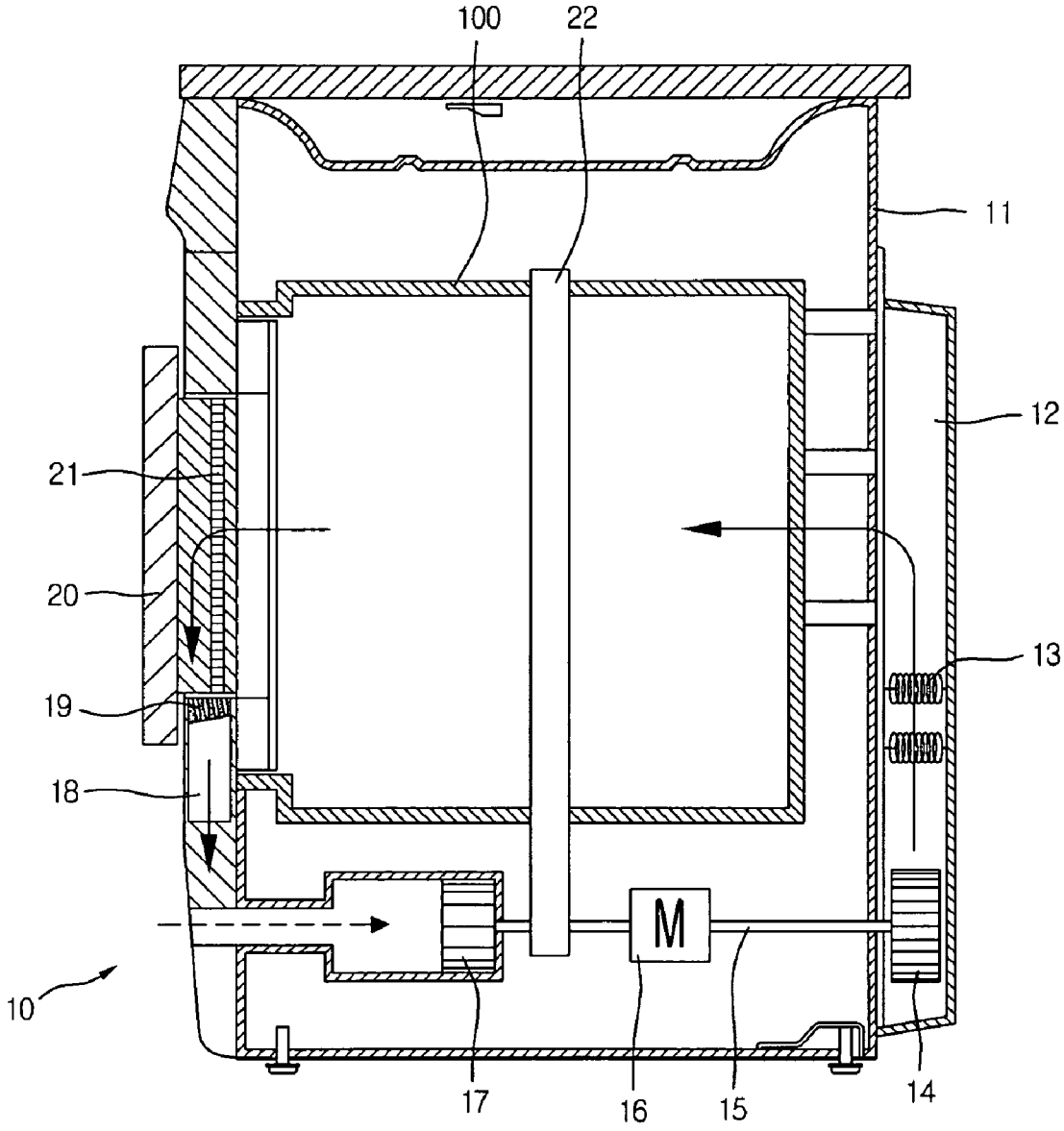
FIG. 1 is a sectional view of a condenser-type laundry dryer with a vibration/noise reduction device according to an embodiment of the present invention.

FIG. 1 is a sectional view of a condenser-type laundry dryer with a vibration/noise reduction device according to an embodiment of the present invention.

Referring to FIG. 1, a condenser-type laundry dryer 10 includes an outer case 11, a cylindrical drum 100 mounted in the outer case 11 to receive the laundry therein, a door 20 controlling the opening of the drum 100, and a belt 22 disposed around an outer circumference of the drum 100 to rotate the drum 100.

The condenser-type laundry dryer 10 further includes a motor shaft 15 connected to the belt 22 to transmit rotational force to the drum 100, a motor 16 for transmitting the rotational force to the motor shaft 15, and a cooling fan 17 connected to a first end of the motor shaft 15 to rotate by receiving the rotational force of the motor 16 and intake interior air. The laundry dryer 10 further includes a dry fan 14 connected to a second end of the motor shaft 15 to circulate air in the drum 100 and a duct cover 12 connecting the dry fan 14 to the drum 100 to allow the air introduced by the dry fan 14 to be directed to the drum 100. The cooling fan 17 and the dry fan 14 are disposed facing each other and the motor 16 is disposed between the cooling and dry fan 17 and 14. The dry fan 14 and the heater 13 are received in the duct cover 12 defining an air passage through which the circulation air introduced by the dry fan 14 is directed reward of the drum 100.

The dryer 10 is formed on a rear surface of the door 20, including a door lint filter 21 for primarily filtering foreign objects contained in the circulation air and a body lint filter 19 for secondary filtering foreign objects contained in the circulation air passing through the door lint filter 21. There is provided a circulation duct 18 along which the circulation air passing through the body lint duct 18 is directed to a condenser (not shown). There is further provided a drawer 23 for storing condensing water generated in the condenser.

The operation of the above-laundry dryer will be described hereinafter.

When electric power is applied to the dryer, the motor 16 rotates and the heater 13 mounted in the duct cover 12 is excited. Then, the belt 22 connected to the motor shaft 28 rotates to rotate the drum 100. As the drum 100 rotates, the laundry in the drum 100 is lifted 300 and dropt by the lift 300 (see FIG. 2) mounted on the inner wall of the drum 100.

Meanwhile, the dry fan 14 connected to the motor shaft 15 rotates by the rotation of the motor 16 to introduce the circulation air via the condenser. The air flows upward along the duct cover 12 and passes through the heater 13 to be converted into high-temperature/drying air. Then, the air is directed into the drum to absorb the moisture contained in the laundry, thereby being converted into the high-temperature/damp air.

The high-temperature damp air is directed to the condenser 310 along the circulation duct 18 via the door lint filter 21 and the body lint filter 19.

Meanwhile, as the cooling fan 17 connected to the motor shaft 15 rotates, outer interior air is induced into the dryer 17. The interior air is directed to the condenser via the cooling fan 17. The high-temperature/damp air and the interior air are not mixed with each other but heat-exchanged.

Accordingly, the high-temperature/damp air gives heat to the interior air as it goes through the condenser, thereby being changed into low-temperature/damp air, in the coursed of which the moisture contained in the low-temperature/damp air is condensed. The condensed moisture is dropt on the floor of the condenser and is then directed to a sump (not shown).

The moisture directed to the sump is transmitted to the drawer 23 disposed on an upper portion of the dryer. Meanwhile, the interior air passing trough the condenser takes the heat from the high-temperature/damp air to change the circulation air into the lower-temperature/damp air. As a result, the temperature of the interior air is increased.

Here, the circulation air introduced by the dry fan 14 flows along the passage defined by the duct cover 12. Then, as it passes through the heater 13, it is changed into the high-temperature/drying air and is then directed into the drum 100.

As described above, the circulation air circulates in the order of the drum, the lint filters, the condenser and the duct cover.

Figure 2:
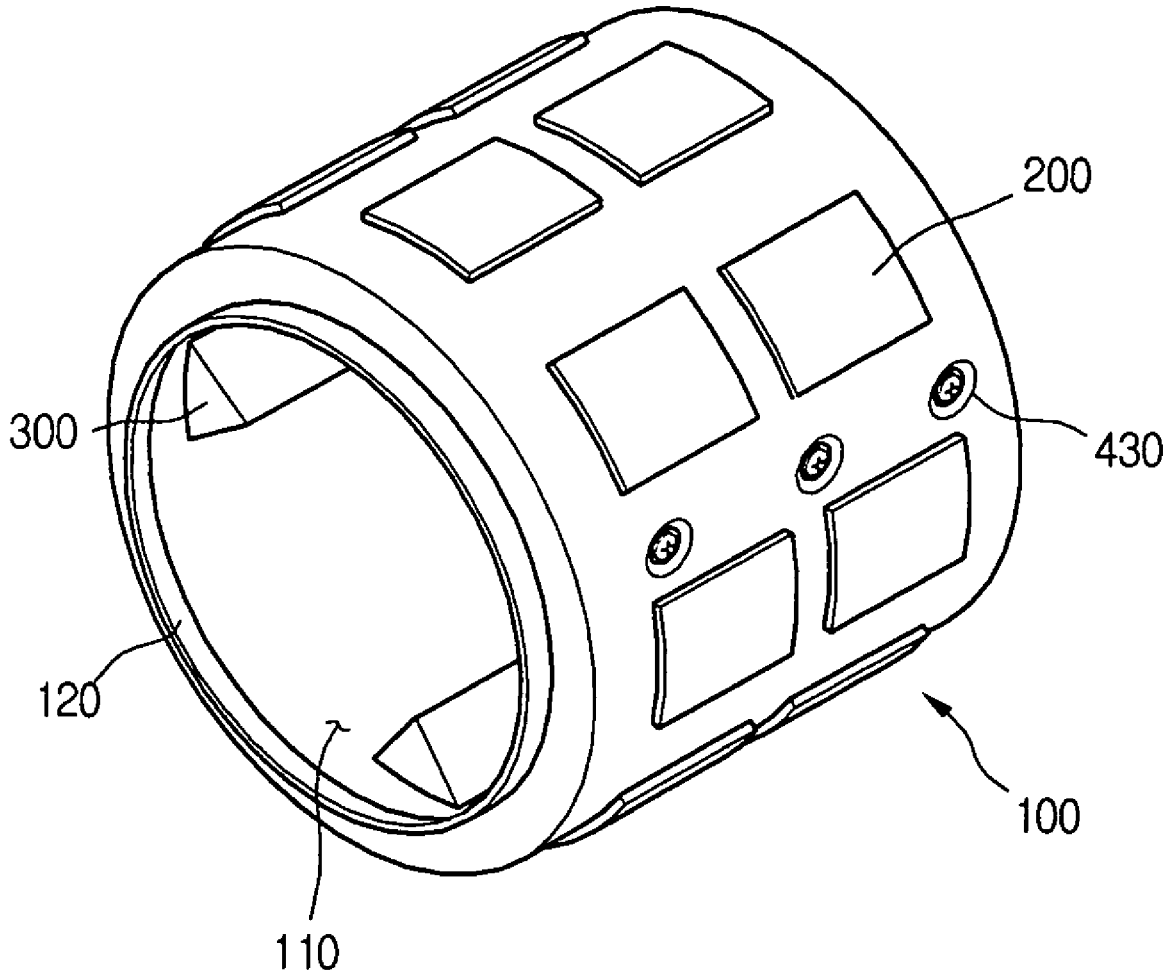
FIG. 2 is a perspective view of a drum with a vibration/noise reduction device according to an embodiment of the present invention.
Figure 3:
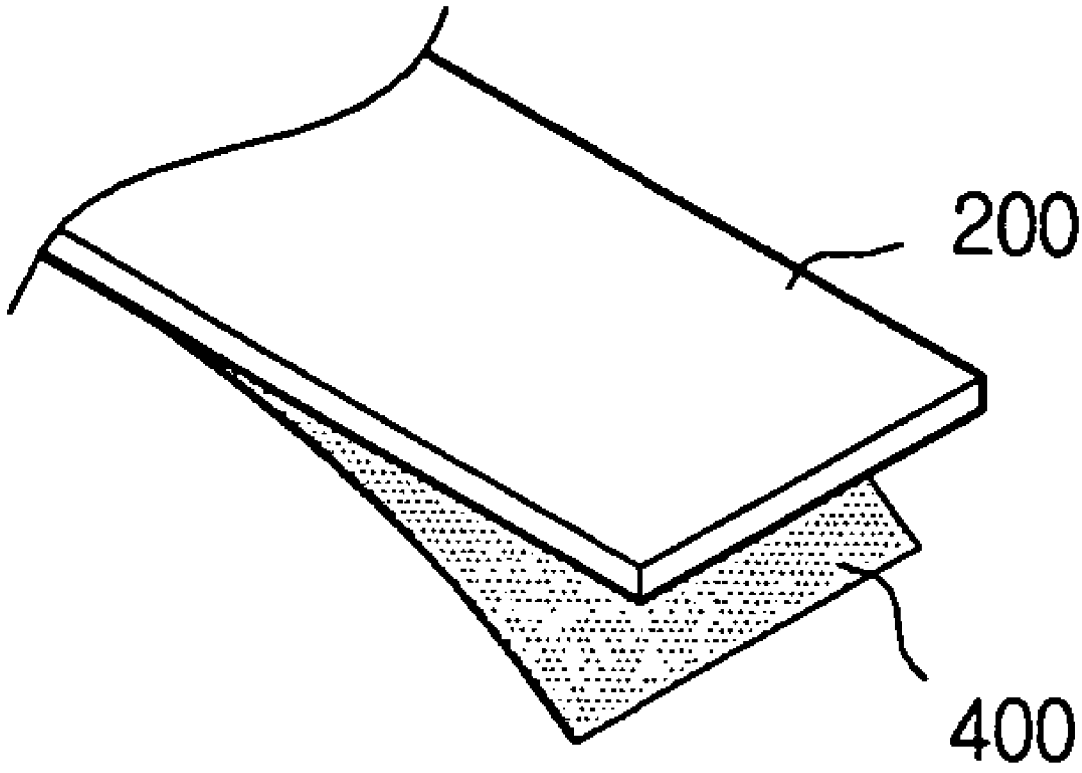
FIG. 3 is a perspective view of an attaching member provided on a vibration/noise reduction device according to an embodiment of the present invention.

FIG. 2 is a perspective view of the drum with a vibration/noise reduction device according to an embodiment of the present invention and FIG. 3 is a perspective view of an attaching member provided on a vibration/noise reduction device according to an embodiment of the present invention.

Referring to FIGS. 2 and 3, the dry drum 100 defines a laundry chamber 110 for receiving the laundry to be dried. One or more noise reduction members 200 are mounted on an outer wall of the dry drum 100. The laundry loaded in the chamber 110 is lifted by one or more lifts 300 formed on an inner wall of the drum 100.

That is, the dry drum 100 is provided at an inlet with a circular drum support 120. A coupling member 430 penetrates the dry drum 100 to fix the lift 300 on the inner wall of the dry drum 100. As described above, a belt 22 is disposed around the central outer circumference of the drum 100. When the motor shaft 15 rotates by the rotation of the motor 16, the belt 22 rotates the dry drum 100.

The noise reduction member 200 attached on the outer wall of the dry drum 100 can be put on the outer wall of the dry drum to prevent the collision noise generated in the dry drum 100 from being propagated to an exterior side.

The noise reduction member 200 may be formed of a material selected from rubber, plastic, stainless steel plated with zinc or tin. It is preferable to use the zinc or tin as it is chip and there is no possibility of rust.

As shown in the drawings, when the rubber is used as the noise reduction member 200, adhesive is deposited on the rear surface of the noise reduction member 200 and the noise reduction member 200 is attached on the outer wall of the dry drum 100 by the adhesive, thereby absorbing the noise and vibration generated in the dry drum 100.

In addition, the noise reduction member 200 formed of the rubber can be attached on the dry drum 100 using a double-sided tape.

When the rubber is used for the noise reduction member 200, since the flexibility is superior, it is easy to work, improving the noise absorption effect.

Figure 4:
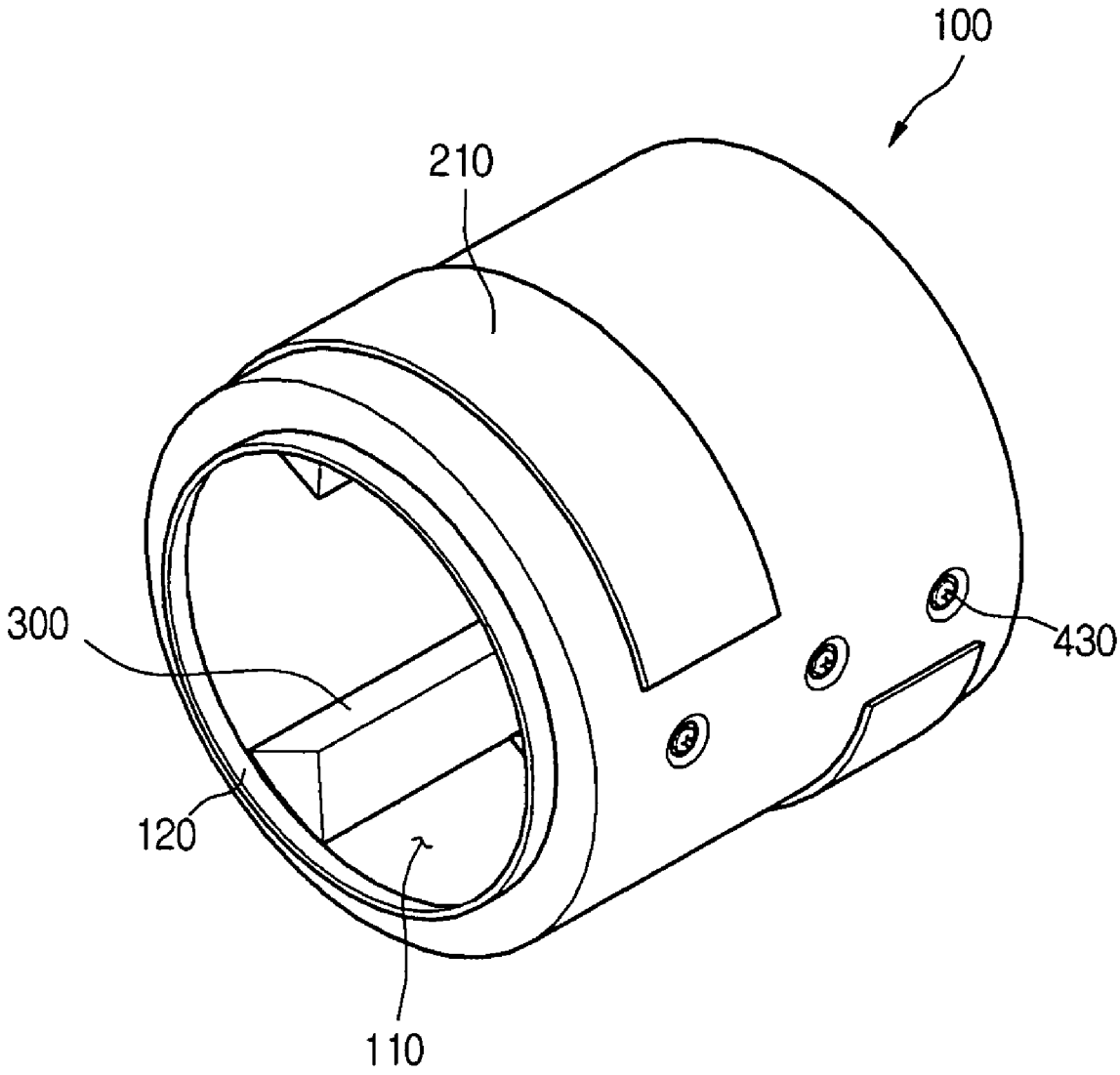
FIG. 4 is a perspective view of a noise reduction member mounted on a dry drum according to another embodiment of the present invention.

FIG. 4 is a perspective view of a noise reduction member mounted on a dry drum according to another embodiment of the present invention.

Referring to FIG. 4, noise reduction members 210 of this embodiment are formed in a rectangular-shape having a predetermined length and width.

When the rectangular-shape noise reduction members 210 are used, the working time can be saved compared with a case where a plurality of small members are attached. A length of the noise reduction member 21 is designed to be about half of that of the circumference of the dry drum 100. The noise reduction members 210 are respectively attached on each half of the outer circumference of the dry drum 100 to be offset each other to reduce the material costs.

Here, the attaching method of the noise reduction members 210 is identical to the forgoing embodiment illustrated with reference to FIG. 2.

Figure 5:
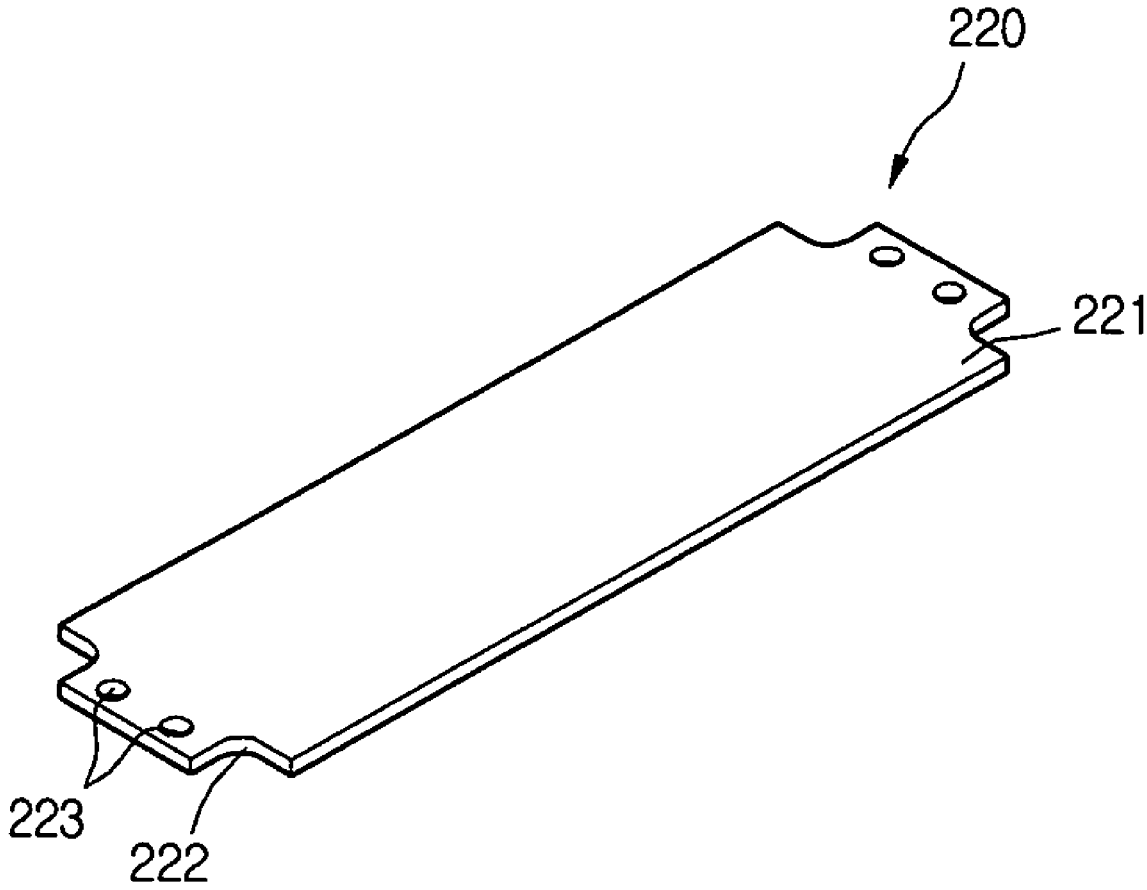
FIG. 5 is a perspective view of a noise reduction member according to another embodiment of the present invention.
Figure 6:
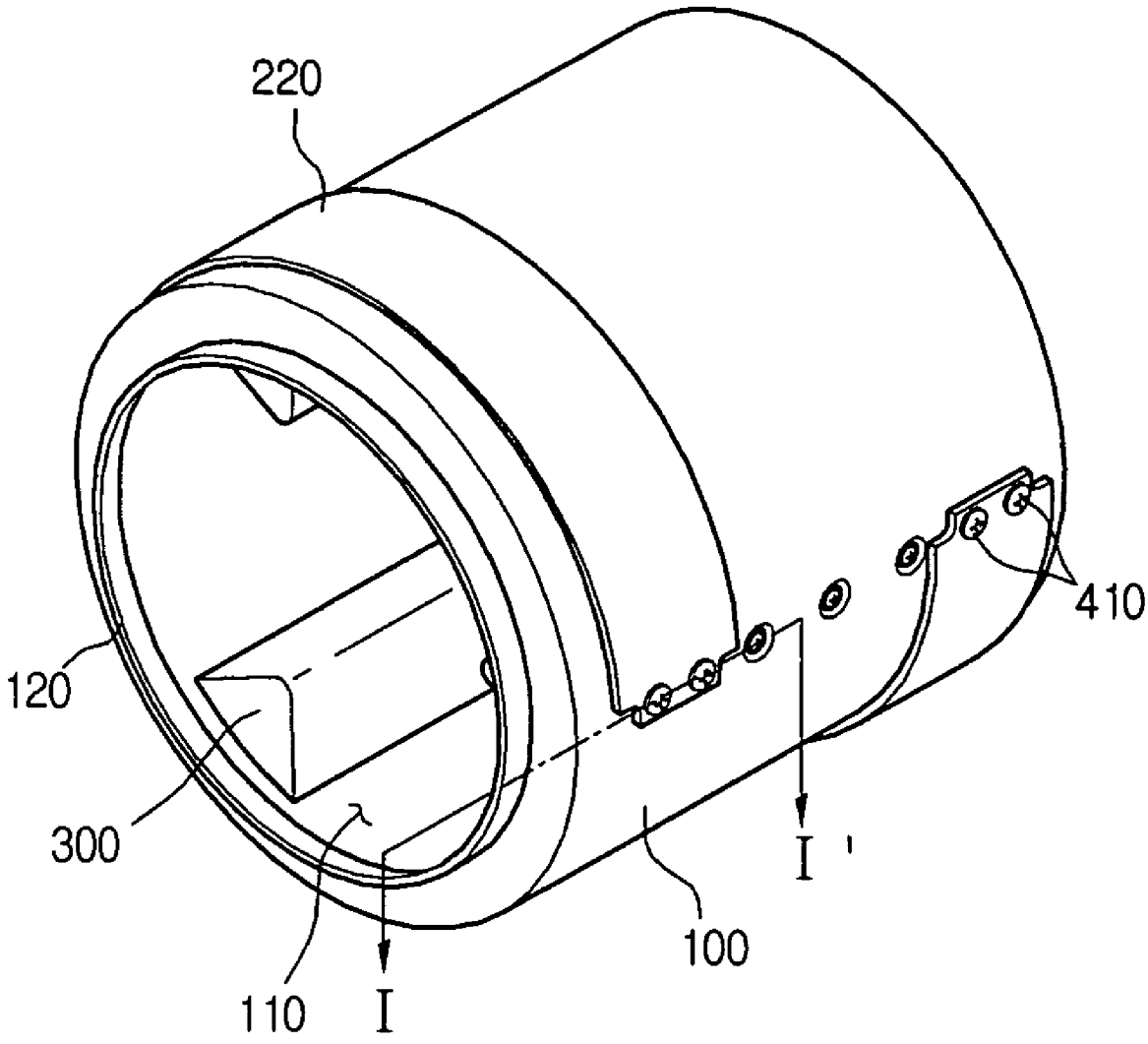
FIG. 6 is a perspective view of a dry drum with a noise reduction member depicted in FIG. 5.

FIG. 5 is a perspective view of a noise reduction member according to another embodiment of the present invention and FIG. 6 is a perspective view of a dry drum with a noise reduction member depicted in FIG. 5.

Referring to FIGS. 5 and 6, the noise reduction member 220 is formed of metal material.

The noise reduction member 220 is preferably designed having a 0.4–2 mm thickness. When the thickness is less than 4 mm, the vibration and noise generated in the drum cannot be effectively absorbed. When the thickness is greater than 2 mm, since the weight of the drum is increased, the electric consumption for operating the drum is increased.

Coupling holes 223 are formed on opposite ends of the noise reduction member 220. Widths of the opposite ends of the noise reduction member 220, on which the coupling holes 223 are formed, are designed to be less than that of a body portion 221.

Corners formed between the opposite ends of the noise reduction member 220 and the body portion 221 are rounded with a predetermined curvature. Accordingly, when tension is applied to the noise reduction member 220 to attach the noise reduction member 220 on the dry rum 100, it can be prevented that the opposite ends split from the body portion 221 by the stress.

As shown in FIG. 6, the noise reduction member 220 is securely attached on the outer circumference of the dry drum 100 by coupling members 410.

The coupling members 410 penetrate the dry drum 100 via the noise reduction member 220. Extreme ends of the coupling members 410 are coupled to the lifts 300. That is, the noise reduction members 220, the dry drum 100 and the lifts 300 are integrally coupled to each other by the coupling members 410.

The noise reduction member 220 may be formed of plastic such that it has a curvature identical to the outer circumference of the drum 100.

In this case, it is also preferable that opposite ends of the noise reduction member 220 and the body portion of the noise reduction member 220 are rounded.

Further preferably, the noise reduction member 220 is formed of high heatproof plastic so that it can maintain its attaching state even when the temperature of the drum 100 is increased.

Figure 7:
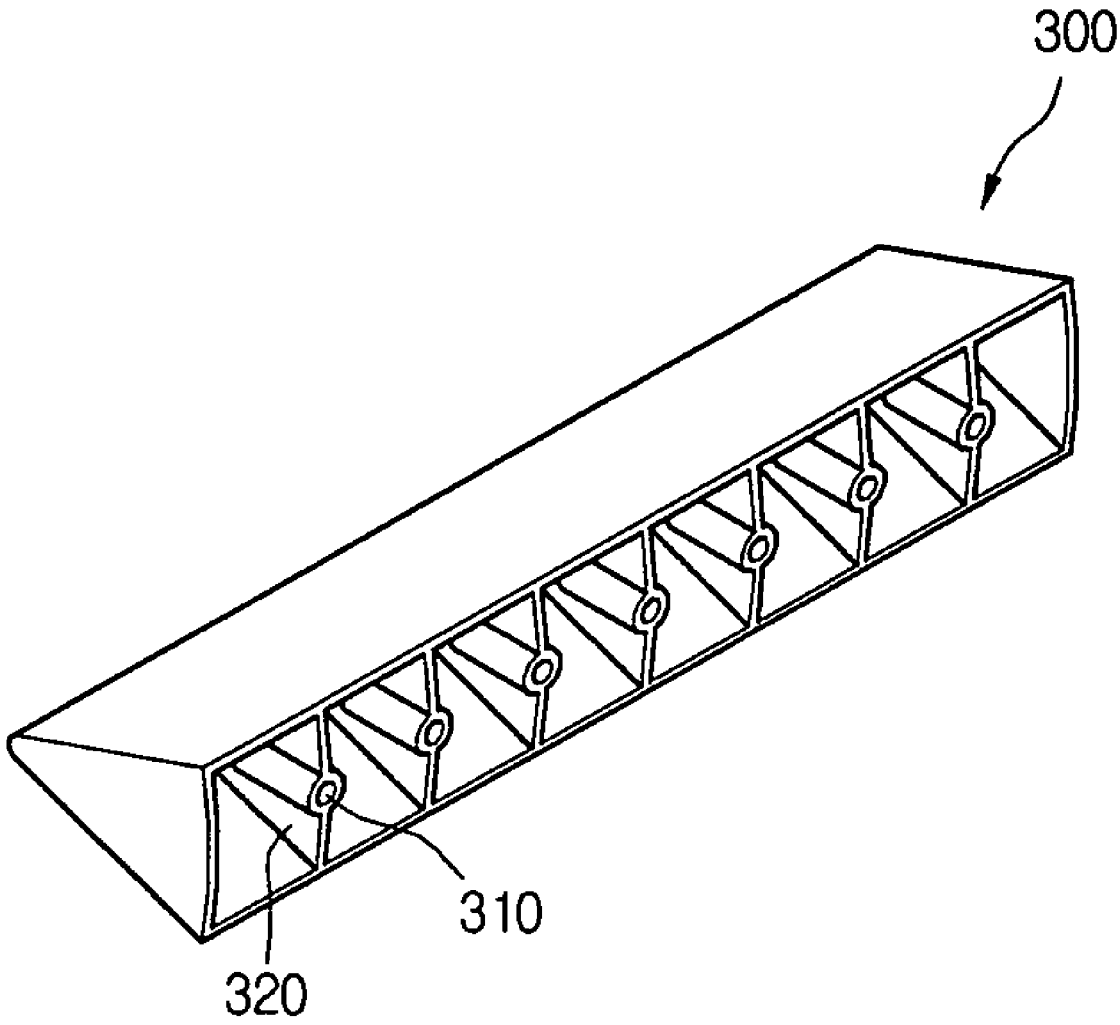
FIG. 7 is a perspective view of a lift for mounting in a dry drum according to an embodiment of the present invention.
Figure 8:
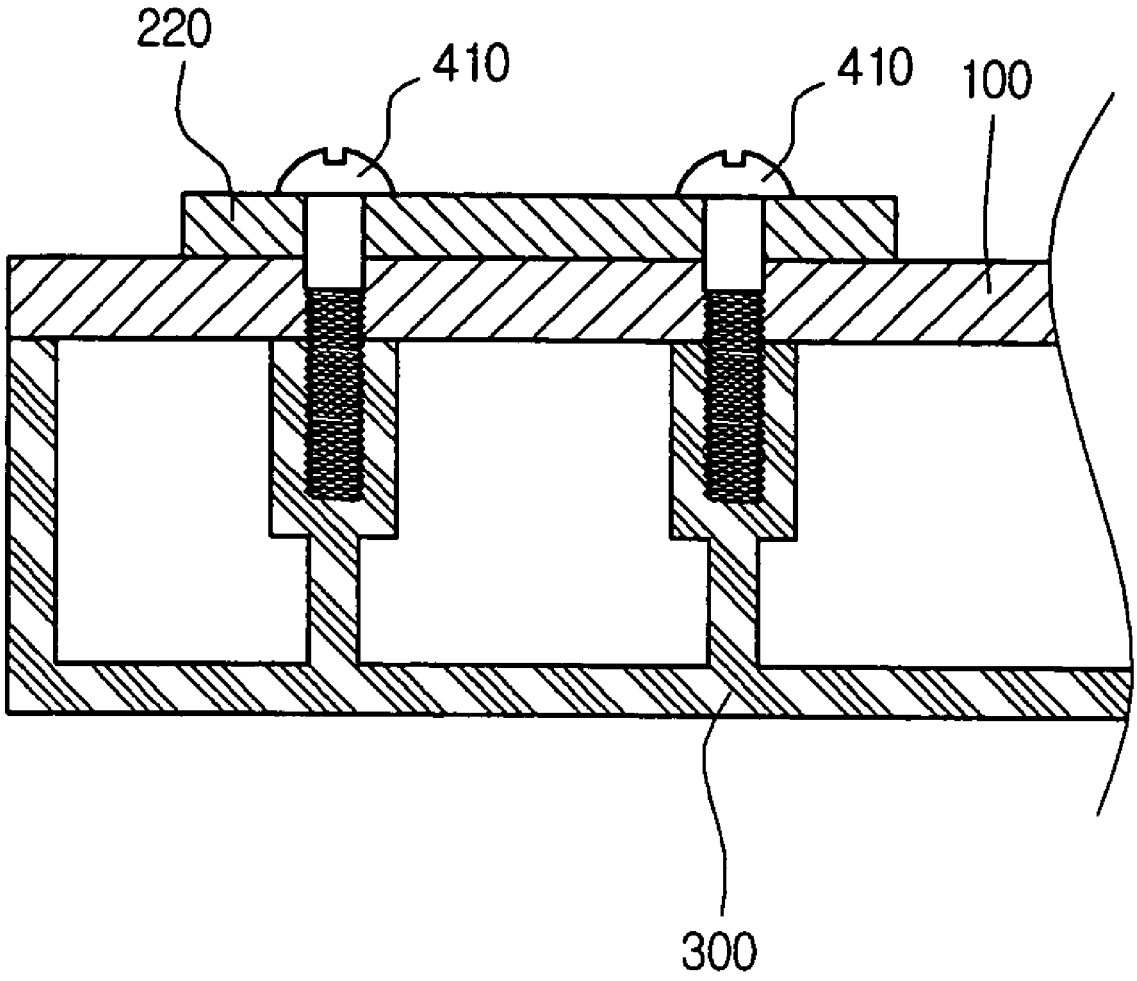
FIGS. 8 and 9 are sectional views taken along line I–I' of FIG. 6.
Figure 9:
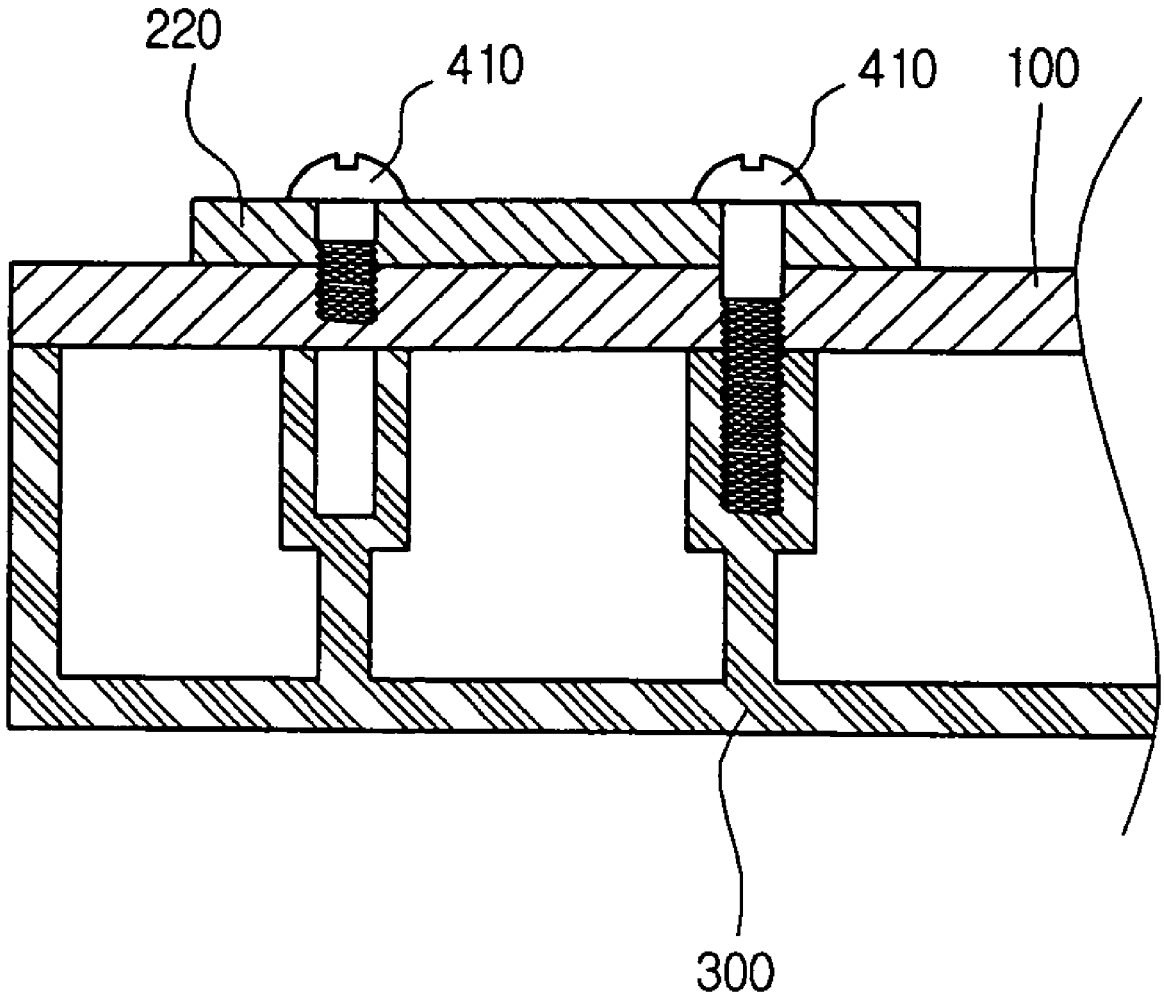

FIG. 7 is a perspective view of a lift for mounting in a dry drum according to an embodiment of the present invention;

FIGS. 8 and 9 are sectional views taken along line I–I' of FIG. 6;

Referring to FIGS. 7 through 9, the lift 300 mounted on an inner circumference of the dry drum 100 is attached in a direction of an axis. A section of the lift 300 is formed in a triangular-shape. The lift 300 is provided with coupling bosses 310 in which the coupling members 410 are inserted. The coupling bosses 310 are supported by reinforcing rib 320.

The noise reduction member 220 is disposed on the outer circumference of the dry drum and the lift 300 is disposed on the inner circumference of the dry drum. The coupling members 410 are inserted into the coupling bosses 310, penetrating the dry drum 100. That is, the coupling members 410 function to securely attach the noise reduction member 220 to the outer circumference of the dry rum 100 and to securely attach the lift 300 on the inner circumference of the dry drum 100.

Furthermore, as the coupling members 410 are fitted into the coupling bosses 310 formed on the lift 300, the extreme ends of the coupling members 410 are not projected into the drum. As a result, the damage of the laundry, which may be caused by the friction between the laundry and the extreme ends of the coupling members 410 can be prevented.

In addition, as shown in FIG. 9, at least one of the coupling members 410 can be adjusted in a length such that it can couple only the noise reduction member 220 to the dry drum 100. In this case, the manufacturing costs can be reduced.

Here, the coupling member 410 may be formed of a screw or a pin.

Figure 10:
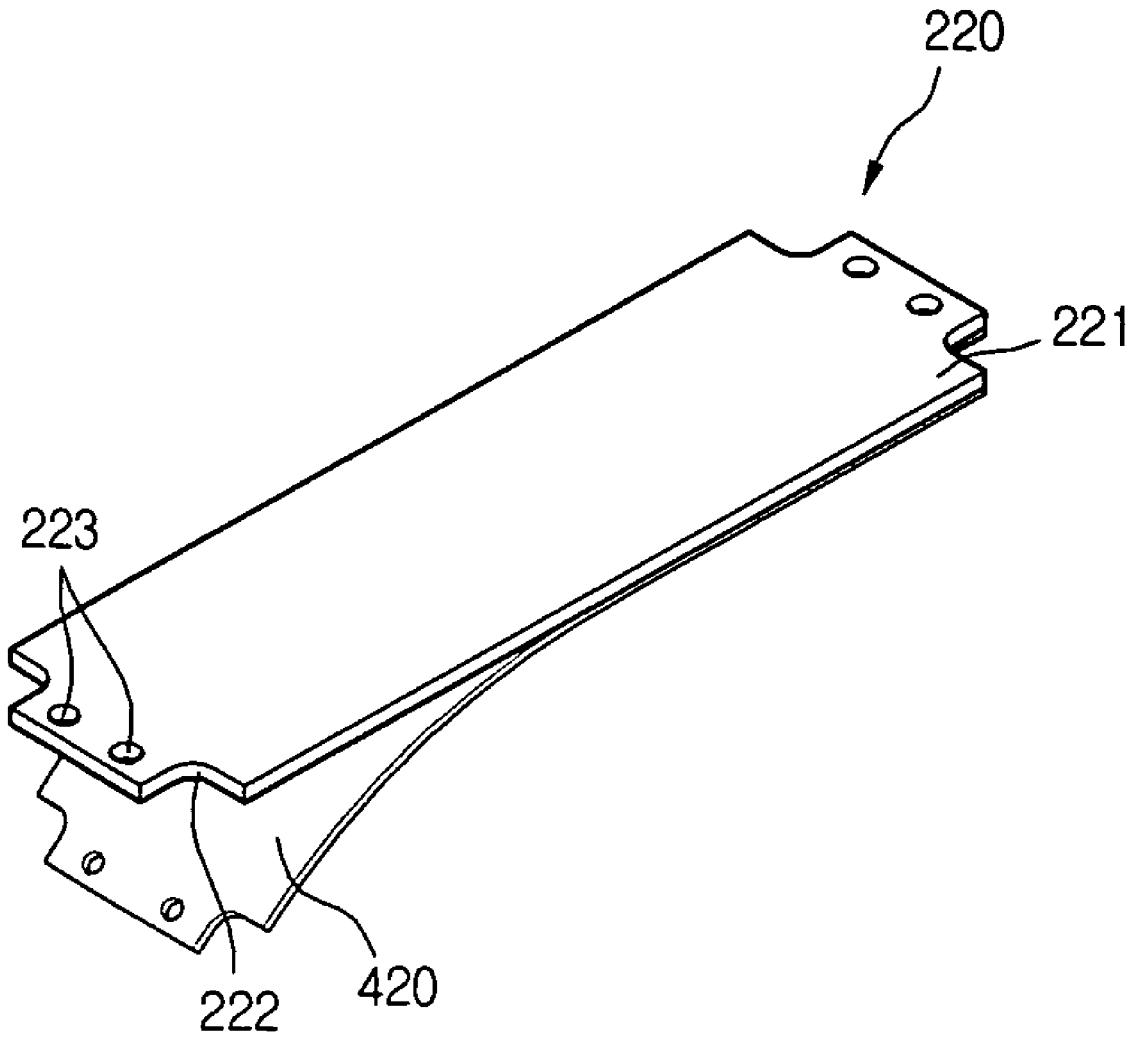
FIG. 10 is a perspective view of a vibration/noise reduction device according to another embodiment of the present invention.
Figure 11:
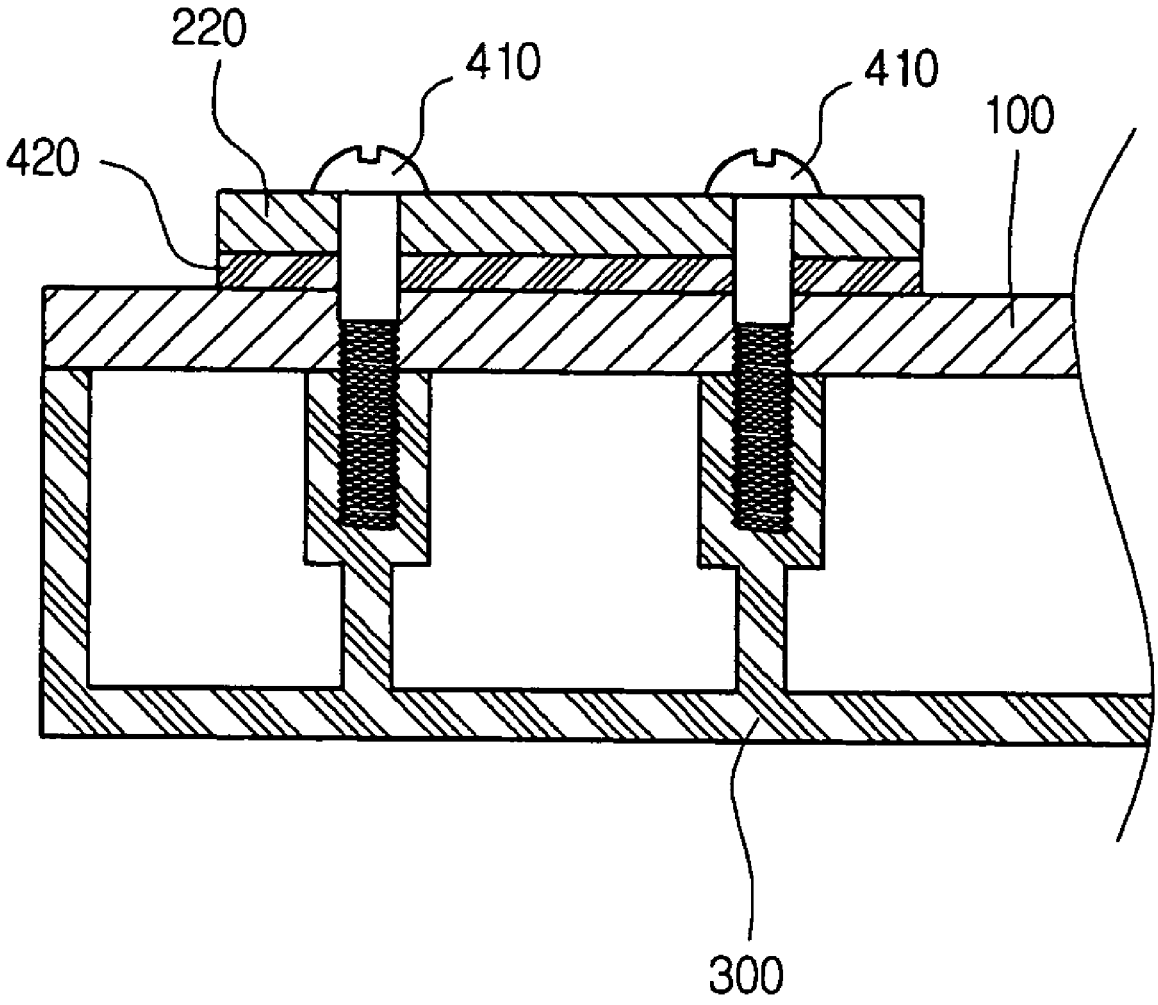
FIG. 11 is a partial sectional view of a dry drum on which a vibration/noise reduction device depicted in FIG. 11 is attached.

FIG. 10 is a perspective view of a vibration/noise reduction device according to another embodiment of the present invention and FIG. 11 is a partial sectional view of a dry drum on which a vibration/noise reduction device depicted in FIG. 11 is attached.

In this embodiment, the noise reduction member may be associated with a vibration reduction member.

That is, an insert pad functioning as the vibration reduction member 420 formed of rubber may be further attached on a bottom of a noise reduction member 220 formed of metal in order to more effectively absorb the vibration and the noise.

As a result, the vibration/noise generated in the dry drum 100 is primarily absorbed by the insert pad 420 and then secondary absorbed by the noise reduction member 220 attached on the top of the insert pad 420.

Adhesive may be used to attach the noise reduction member 220 to the insert pad 420. Alternatively, the noise reduction member 220 and the insert pad 420 may tightly contact each other by the coupling members 410.

As shown in FIG. 11, the noise reduction member 220, the vibration reduction member 420 and the lift 300 are coupled to each other by the coupling members 410. Likewise, at least one of the coupling members 410 may be adjusted in a length to only one of the vibration reduction and noise reduction members 420 and 220 can be coupled to the dry drum 100.

Figure 12:
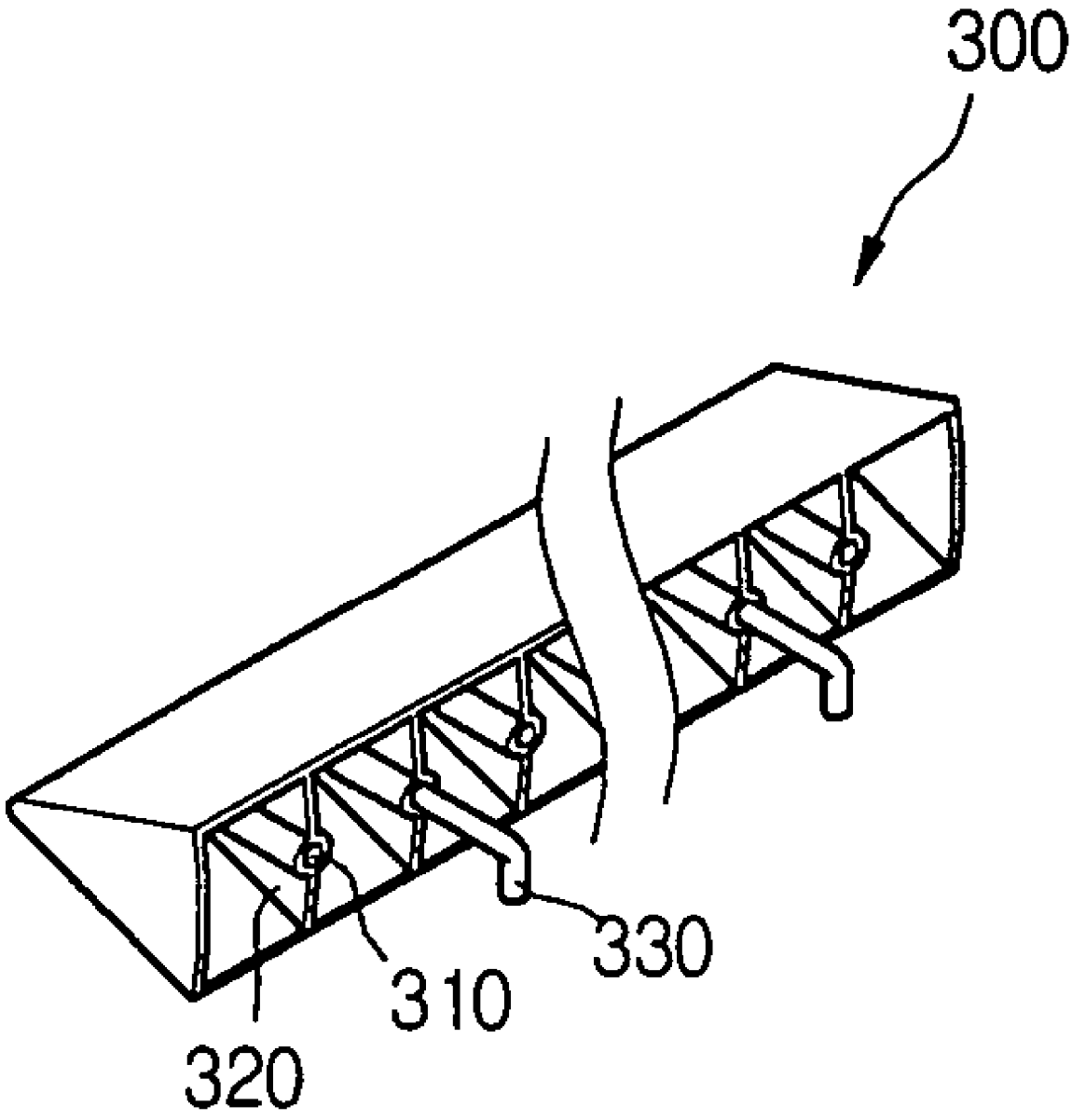
FIG. 12 is a perspective view of a lift for mounting in a dry drum according to another embodiment of the present invention.
Figure 13:
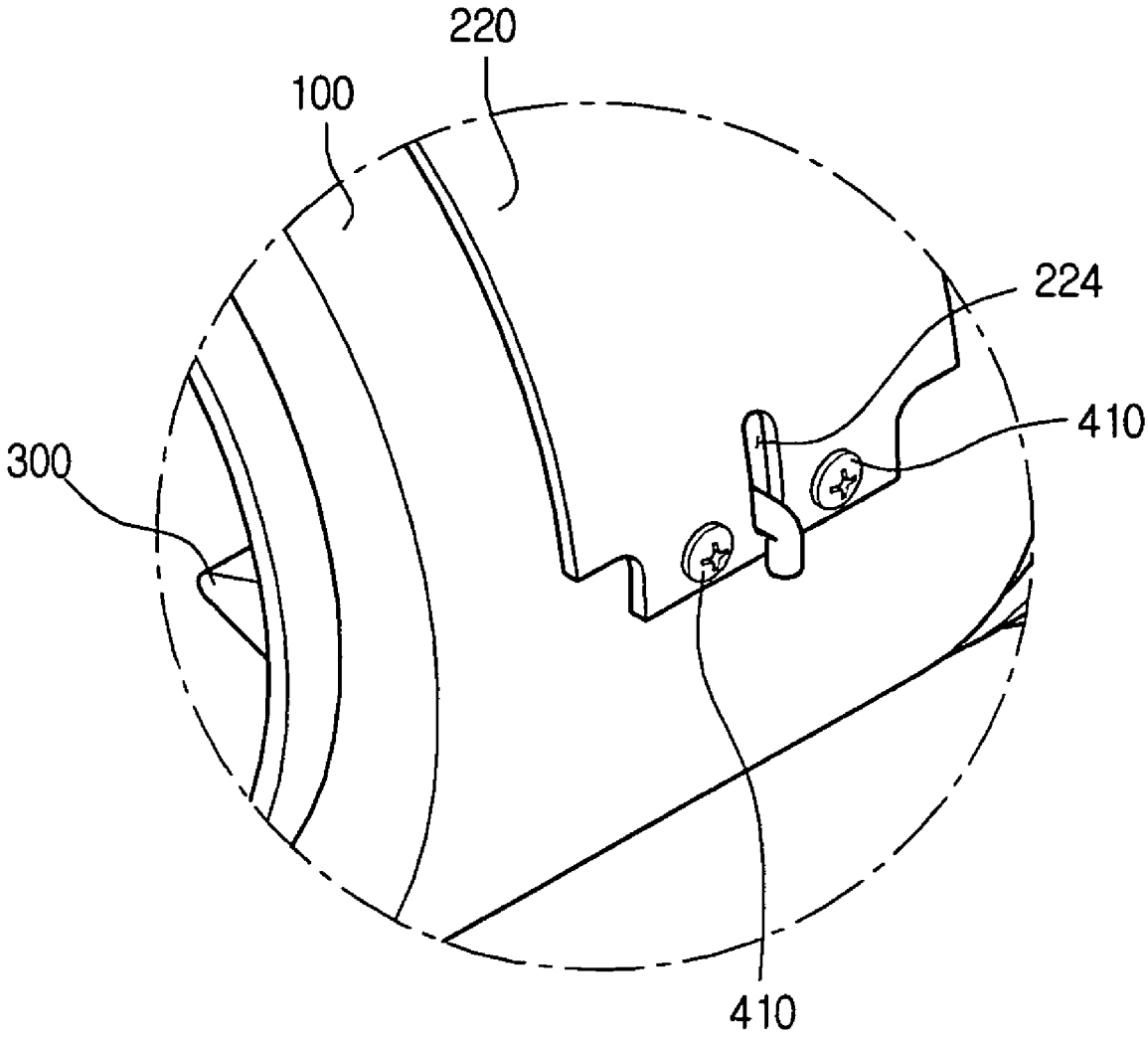
FIG. 13 is a partial perspective view of a dry drum with a lift depicted in FIG. 12, on an outer circumference of which a noise reduction member is mounted.

FIG. 12 is a perspective view of a lift for mounting in a dry drum according to another embodiment of the present invention and FIG. 13 is a partial perspective view of a dry drum with a lift depicted in FIG. 12, on an outer circumference of which a noise reduction member is mounted.

Referring to FIGS. 12 and 13, coupling projections 330 are formed on a bottom of the lift 300 between the coupling bosses 310.

The coupling projections 330 function to guide a coupling location of the noise reduction member 220 to the coupling members 410.

Meanwhile, heights of the coupling projections 330 is identical to or greater than that sum of a thickness of the drum 100 and a thickness of the noise reduction member 220 in order to prevent the noise reduction member 220 from being separated from the coupling projections 330 in a preliminarily assembling state.

Coupling projection hook holes 224 are formed between the coupling holes 223 on the noise reduction member 220. The coupling projections 330 are inserted into the coupling projection hook holes 224. It is preferable that the coupling projection hook holes 224 are formed in an oval-shape so that a bent ends of the coupling projections 330 can be easily inserted therein.

Figure 14:
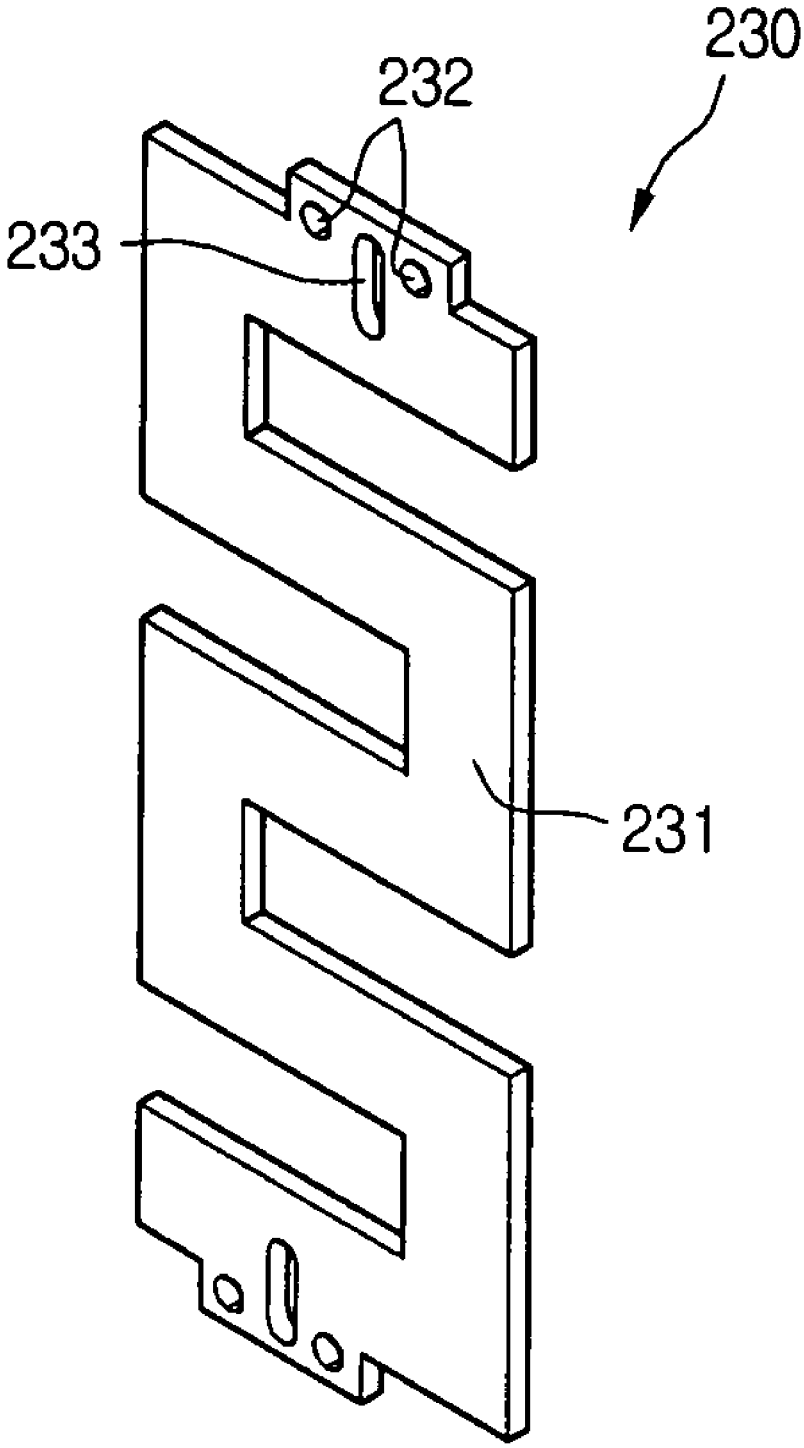
FIG. 14 is a noise reduction member according to another embodiment of the present invention.

FIG. 14 is a noise reduction member according to another embodiment of the present invention.

In this embodiment, a noise reduction member 230 is designed to have a meander line formed by cutting a portion of a body portion 231. As a result, when opposite ends of the noise reduction member 230 are pulled away from each other, the noise reduction member 230 can be retractably expanded. In addition, more noise reduction members 230 can be obtained from an identical unit size material compared with the rectangular noise reduction members.

Figure 15:
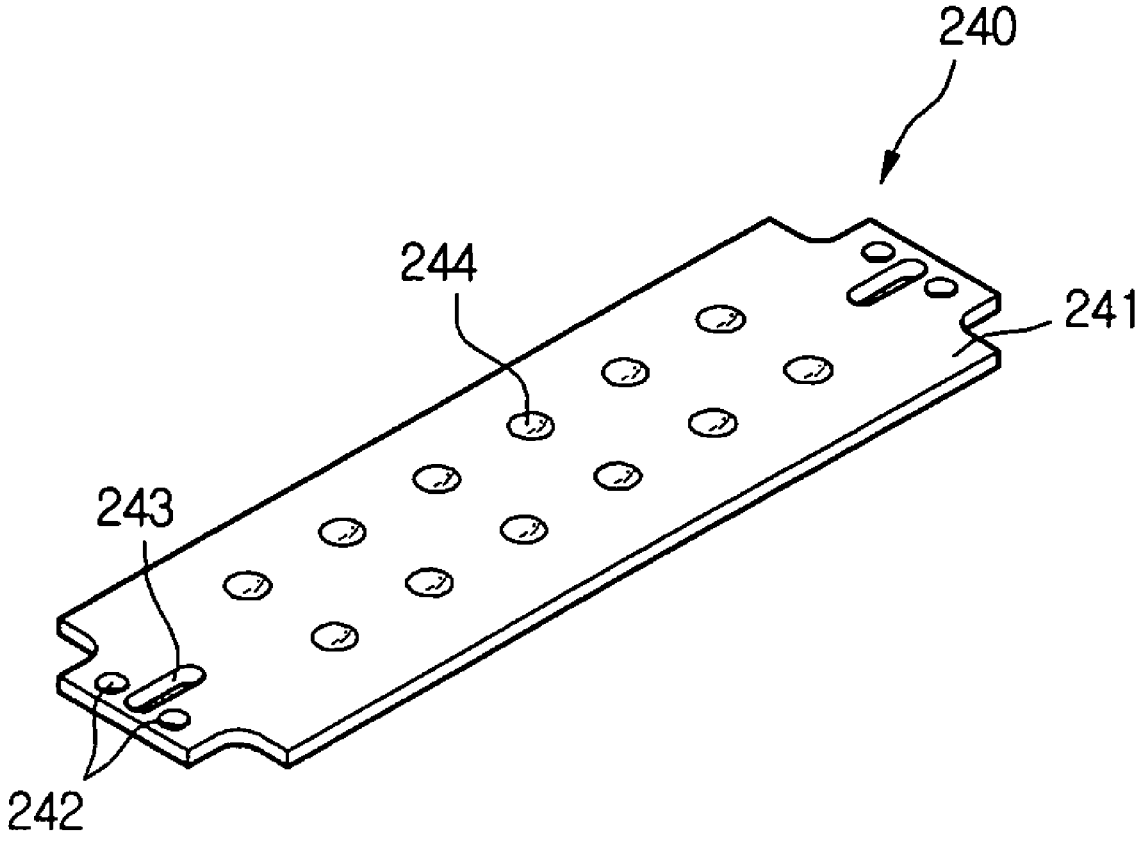
FIG. 15 is a noise reduction member according to another embodiment of the present invention.

FIG. 15 is a noise reduction member according to another embodiment of the present invention;

In this embodiment, a noise reduction member 240 may be provided with a plurality of embossments 244. As a result, when opposite ends of the noise reduction member 240 are pulled away from each other, the noise reduction member 240 can be retractably expanded as the shape of the embossment is changed into an oval-shape.

In the noise reduction members depicted in FIGS. 14 and 15, the extending opposite ends, the coupling holes and the coupling projection hook holes can be selectively varied if required.

Figure 16:
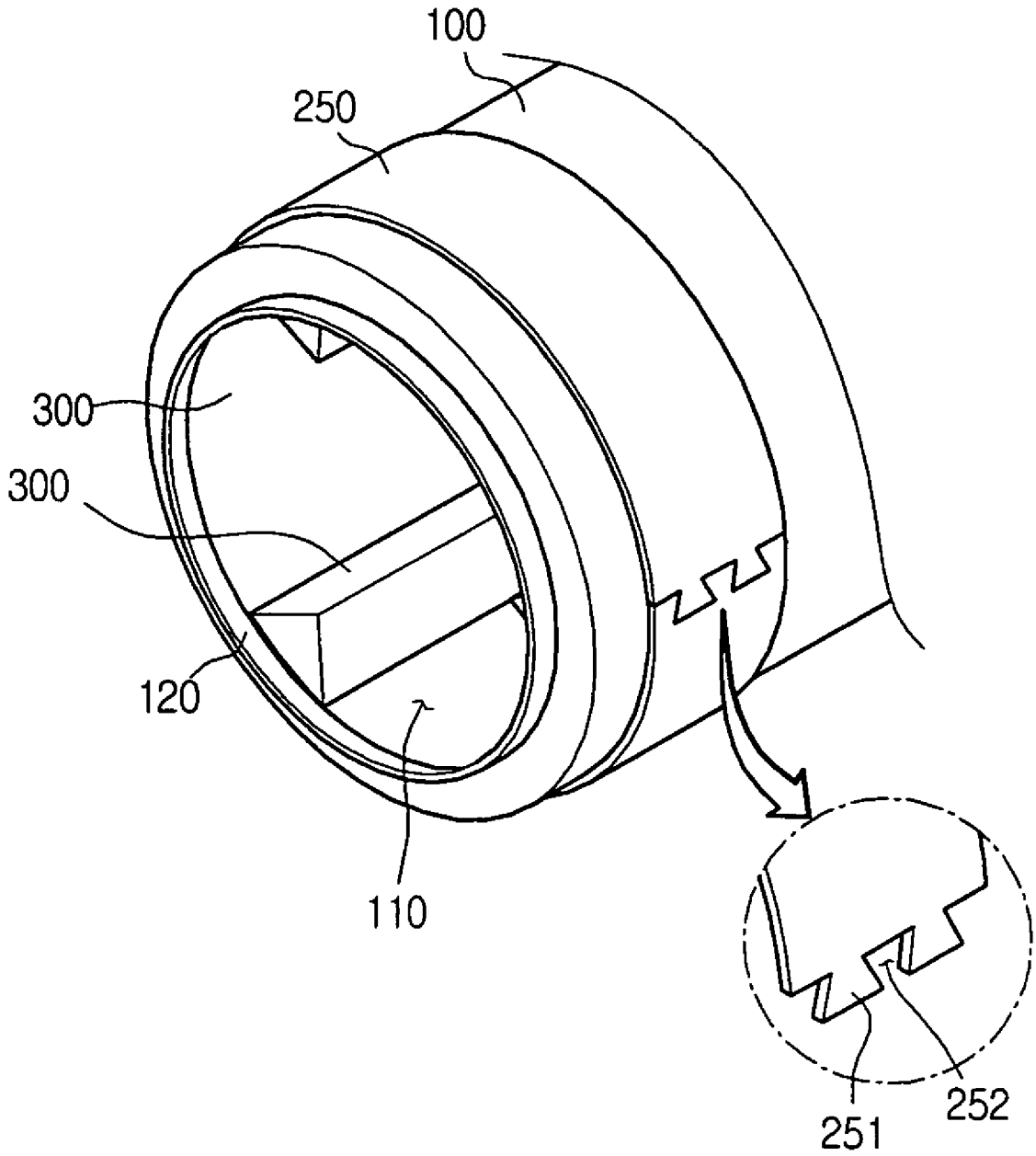
FIG. 16 is a partial perspective view of a dry drum, on an outer circumference of which a noise reduction member is mounted according to another embodiment of the present invention.

FIG. 16 is a partial perspective view of a dry drum, on an outer circumference of which a noise reduction member is mounted according to another embodiment of the present invention.

In this embodiment, the noise reduction member 250 is provided at a first end with one or more trapezoid projections 251. That is, a width of the projection 251 is gradually increased as it goes from the end of the noise reduction member 250 to its extreme end so that an insertion portion 252 can be defined between the trapezoid projections 251. A trapezoid projection formed on a second end of the noise reduction member 250 is accurately inserted into the insertion portion 251.

That is, the noise reduction member 250 is disposed around the outer circumference of the dry drum 10 by one turn and the projection 260 is interlocked with the insertion portion 261. Here, a length of the noise reduction member 250 is identical to or less than that of the outer circumference of the dry drum 100 so that shearing stress can be applied to side portions of the projections 260 in a state where the opposite ends of the noise reduction member 250 is coupled to each other. As a result, the coupling state of the noise reduction member 250 can be firmly maintained by tensile strength. As described above, there is no special coupling members are not required to mount the noise reduction member 250 around the dry drum 100.

Figure 17:
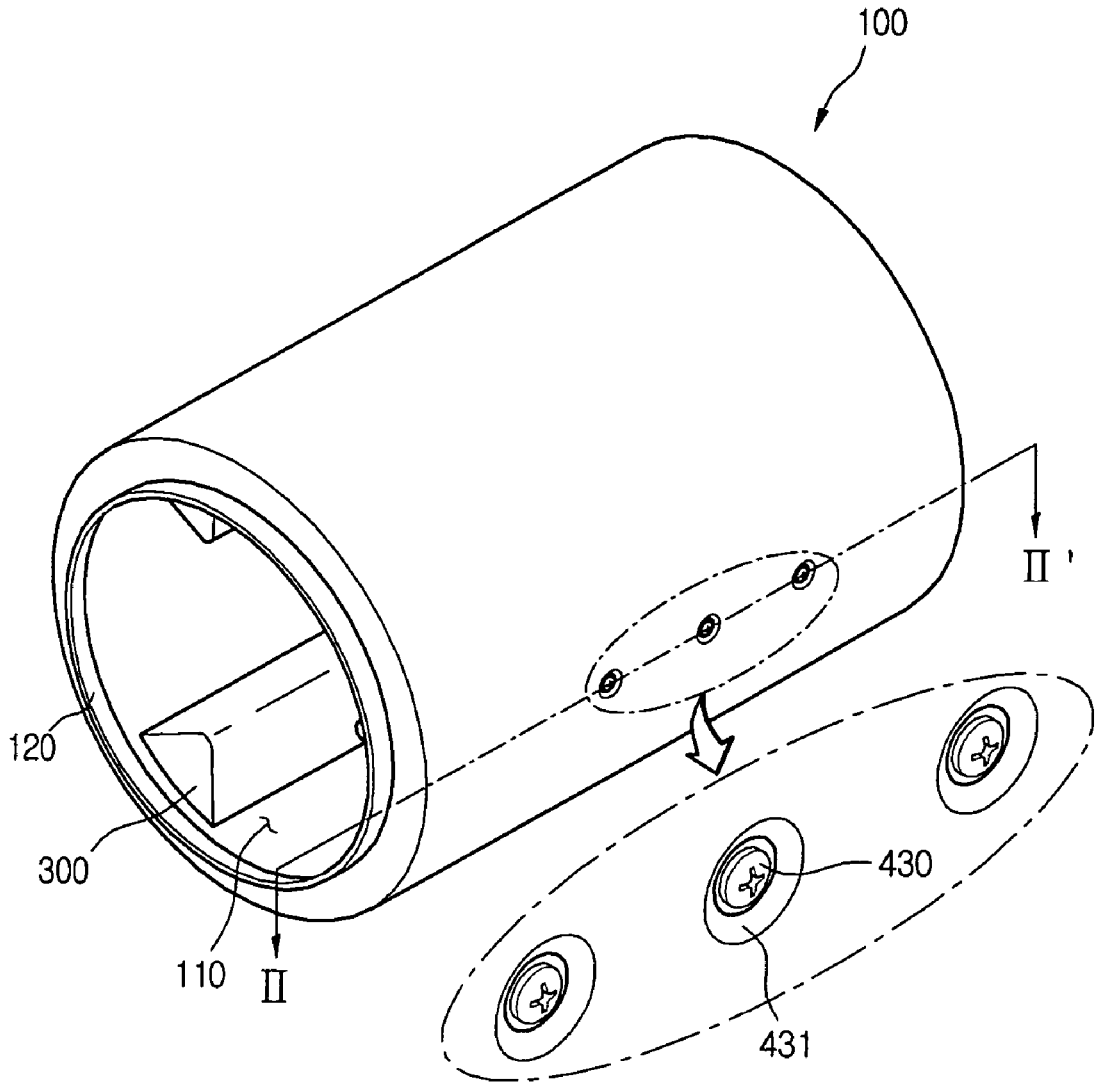
FIG. 17 is a perspective view of a coupling structure formed on an outer circumference of a dry drum according to an embodiment of the present invention.
Figure 18:
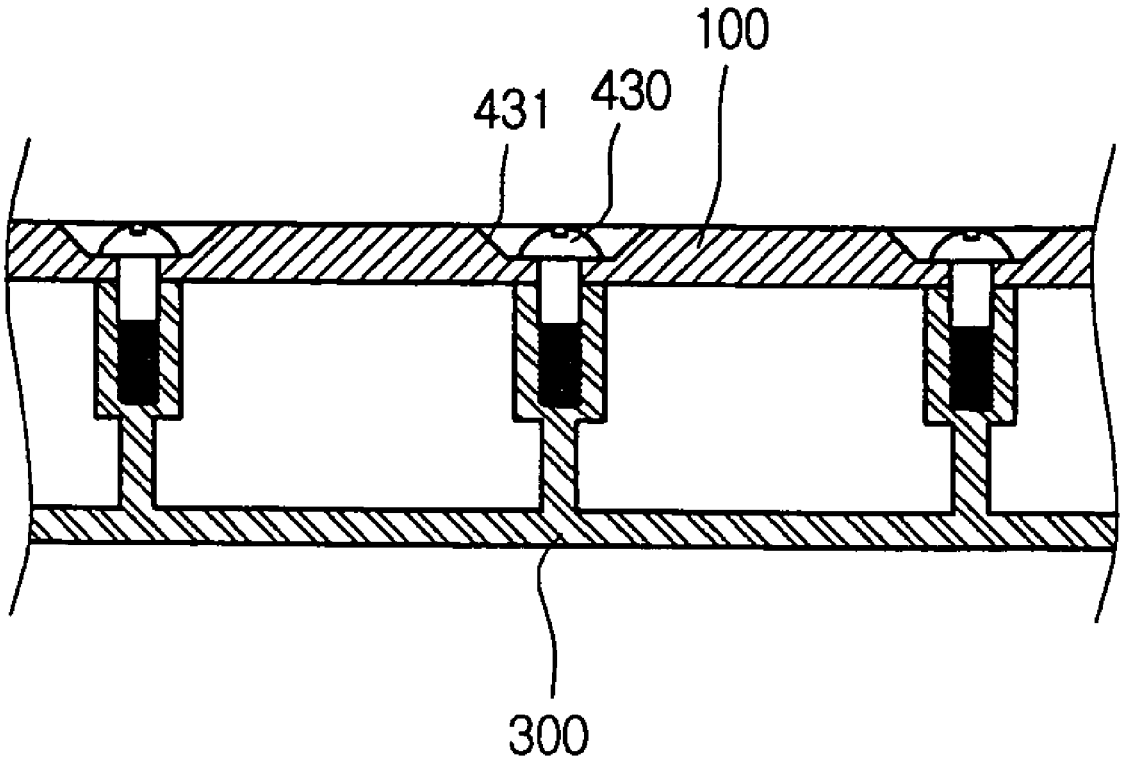
FIG. 18 is a sectional view taken along line II–II' of FIG. 17.

FIG. 17 is a perspective view of a coupling structure formed on an outer circumference of a dry drum according to an embodiment of the present invention and FIG. 18 is a sectional view taken along line II–II' of FIG. 17.

Referring to FIGS. 17 and 18, one or more lifts 300 are mounted on the inner circumference of the dry drum 100. The lift 300 is securely coupled to the inner circumference of the dry drum 100 by one or more coupling members 430.

Since the belt 22 is disposed around the outer circumference of the dry drum 100, there may be interference between head portions of the coupling members 430 and the belt 22 in the course of rotating the dry drum 100.

To solve this problem, it is preferable that the head portion of the coupling member 430 is inserted to be lower than the outer circumference of the dry drum 100.

That is, the dry drum 100 is provided with a concave portion 431 in which the head portion of the coupling member 430 can be completely buried.

As a result, the head portion of the coupling member 430 does not interfere with the belt 22 to prevent the belt 22 from being damaged, thereby prolonging the service life of the belt 22.

Another coupling member 410 for attaching the noise reduction member to the dry drum 100 may be inserted on a portion spaced from the concave portion 431 by a predetermined distance.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A laundry dryer comprising:

a dry drum in which laundry is loaded;

at least one noise reduction member mounted on an outer circumference of the dry drum to absorb vibration/noise;

a lift attached on an inner circumference of the dry drum to lift the laundry;

a coupling member coupling the noise reduction member and/or the lift to the dry drum; and a belt disposed around the dry drum, wherein the dry drum is provided with a concave portion to prevent a head portion of the coupling member from interfering with the belt, and the noise reduction member is formed of a material selected from the group consisting of stainless steel plated with zinc or tin rubber and plastic.

2. The laundry dryer according to claim 1, further comprising an adhesive layer disposed between the noise reduction member and the dry drum.

3. The laundry dryer according to claim 1, wherein the noise reduction member is attached on the dry drum by adhesive.

4. The laundry dryer according to claim 1, wherein the noise reduction member is attached on the dry drum by a double-sided tape.

5. The laundry dryer according to claim 1, wherein the coupling member is one of a screw and a pin.

6. The laundry dryer according to claim 1, wherein the noise reduction member is formed of strength member having a curvature identical to that of the outer circumference of the drum.

7. A laundry dryer comprising:

a dry drum in which laundry is loaded;

at least one noise reduction member mounted on an outer circumference of the dry drum to absorb vibration/noise;

a lift attached on an inner circumference of the dry drum to lift the laundry;

a coupling member coupling the noise reduction member and/or the lift to the dry drum; and a belt disposed around the dry drum, wherein the noise reduction member is provided with a coupling end portion of different width than a main portion of the noise reduction member.

8. The laundry dryer according to claim 7, wherein the coupling end portion is provided with a coupling hole in which the coupling member is inserted.

9. The laundry dryer according to claim 7, wherein a width of the coupling end portion is less than that of the main portion of the noise reduction member.

10. The laundry dryer according to claim 7, wherein a border between the coupling end portion and the main portion of the noise reduction member is rounded.

11. The laundry dryer according to claim 1, further comprising an insert pad interposed between the noise reduction member and the dry drum to further absorb vibration/noise.

12. A laundry dryer comprising:

a dry drum;

a lift attached on an inner circumference of the dry drum to move the laundry;

a strip-shaped noise reduction member disposed around an outer circumference of the dry drum to absorb vibration, the noise reduction member being provided at both end portions with a coupling element; and a coupling members for coupling the end portions of the noise reduction member to physically separated portions of the outer circumference of the dry drum.

13. The laundry dryer according to claim 12, wherein a width of the coupling end is at least identical to or less that that of the end of the noise reduction member.

14. The laundry dryer according to claim 12, wherein a border between the coupling end portion and the main portion of the noise reduction member is rounded.

15. The laundry dryer according to claim 12, wherein the coupling element is a coupling hole in which the coupling member is inserted.

16. The laundry dryer according to claim 12, further comprising an insert pad interposed between the noise reduction member and the dry drum to further absorb vibration/noise.

17. The laundry dryer according to claim 16, further comprising an adhesive layer between the insert pad and the noise reduction member.

18. The laundry dryer according to claim 16, wherein the insert pad is attached to the noise reduction member by adhesive or a both-sided tape.

19. The laundry dryer according to claim 12, wherein the noise reduction member is disposed on a portion of the outer circumference of the dry drum.

20. The laundry dryer according to claim 12, wherein the noise reduction member is formed of two sections attached on each half of the outer circumference to be offset with respect to each other.

21. The laundry dryer according to claim 12, wherein the noise reduction member and the lift is are integrally coupled to each other by the coupling member.

22. The laundry dryer according to claim 12, wherein at least one coupling member couples only the noise reduction member and the dry drum.

23. The laundry dryer according to claim 12, wherein the noise reduction member has a meander line shape.

24. A laundry dryer comprising:

A dry drum in which laundry is loaded;

at least one noise reduction member mounted on an outer circumference of the dry drum to absorb vibration/noise;

a lift attached on an inner circumference of the dry drum to lift the laundry;

a coupling member coupling the noise reduction member and/or the lift to the dry drum, and a belt disposed around the dry drum, wherein the noise reduction member is provided at a top with a plurality of embossments.

25. A laundry dryer comprising:

a dry drum in which laundry is loaded;

at least one noise reduction member mounted on an outer circumference of the dry drum to absorb vibration/noise;

a lift attached on an inner circumference of the dry drum to lift the laundry;

a coupling member coupling the noise reduction member and/or the lift to the dry drum, and a belt disposed around the dry drum, wherein the coupling end includes one or more first projections extending from a first end of the noise reduction member and having a width that is increased as it goes away from a body portion, and a second projection is formed on a second end of the noise reduction member, the second projection being interlocked with an insertion portion defined by the first projections.

26. A laundry dryer comprising:

a dry drum in which laundry is loaded;

a lift mounted in an inner circumference of the drum in a direction of an axis, the lift being provided with a coupling guide projection;

a noise reduction member mounted on an outer circumference of the dry drum, the noise reduction member having an end portion with at least one coupling hole in which a coupling member is inserted; and wherein the noise reduction member is provided with a hook hole in which the bent end of the coupling guide projection is inserted.

27. The laundry dryer according to claim 26, wherein the hook hole has a length identical to or greater than that of the bent end of the coupling guide projection.

* * * * *